United States Patent [19]

Anderson

[11] 4,228,419

[45] Oct. 14, 1980

[54] EMERGENCY VEHICLE TRAFFIC CONTROL SYSTEM

[75] Inventor: George P. Anderson, Pawtucket, R.I.

[73] Assignee: Electronic Implementation Systems, Inc., Riverside, R.I.

[21] Appl. No.: 932,264

[22] Filed: Aug. 9, 1978

[51] Int. Cl.[2] ..... G08G 1/07

[52] U.S. Cl. ..... 340/32; 340/167 B; 340/168 R; 455/99; 455/260

[58] Field of Search ..... 340/32, 33, 34, 311, 340/167 B, 168 R, 168 S, 168 B, 146.1 BA; 325/55, 325, 64, 419, 117, 38 R; 343/225, 228

[56] References Cited

U.S. PATENT DOCUMENTS

| | | | |
|---|---|---|---|
| 3,588,825 | 6/1971 | Shook et al. | 340/167 B |
| 3,836,959 | 9/1974 | Pao et al. | 340/168 R |
| 3,881,169 | 4/1975 | Malach | 340/32 |
| 4,001,772 | 1/1977 | Powell et al. | 340/311 |
| 4,016,532 | 4/1977 | Rose | 340/32 |
| 4,017,825 | 4/1977 | Pichey | 340/32 |
| 4,037,201 | 7/1977 | Willmott | 340/311 |

*Primary Examiner*—John W. Caldwell, Sr.
*Assistant Examiner*—James J. Groody
*Attorney, Agent, or Firm*—Barlow & Barlow

[57] ABSTRACT

The present system provides a traffic signal control system which will allow moving emergency vehicles to remotely take control of the traffic signals at an intersection. The transmitter part of the system utilizes a microwave transmitter that is mounted on each emergency vehicle, which transmitter emits a pulse coded message which is received by a permanently fixed receiver at each intersection to be controlled. The receiver includes decoding logic to verify that a valid code request has been transmitted by the vehicle. The receiver includes a directional antenna that faces each direction to be controlled which therefore automatically discriminates against signals being received from other directions, and if the appropriate code is received during a predetermined interval of time, the receiver will cause the traffic signals to cycle so that a green or go phase will be directed to the oncoming emergency vehicle and cross traffic will be warned by red signals facing it. After the emergency vehicle has entered the intersection, lack of direct transmission from it will conclude the control after a fixed delay to allow the vehicle time to clear the intersection. The same fixed delay will enable the vehicle to maintain control of the intersection even if it should momentarily lose direct microwave contact because of an intervening large truck or bus.

5 Claims, 5 Drawing Figures

EMERGENCY VEHICLE TRAFFIC CONTROL SYSTEM

BACKGROUND OF THE INVENTION

The present invention relates to a traffic light signal control which can change the normal traffic mode of operation of the signal to an emergency mode of operation in response to a command from an emergency vehicle.

It is well known that emergency vehicles, such as fire engines, police vehicles and medical vehicles, utilize an audible signal to control traffic in the direction in which they are traveling. For a variety of reasons there have occurred accidents at intersections since drivers of regular vehicles have failed to respond to the audible and visual signals that are emitted by the emergency vehicle. In the past there have been several proposals for controlling intersections directly from emergency vehicles as, for example, the systems disclosed in Long U.S. Pat. No. 3,550,078 and Coll et al U.S. Pat. No. 3,638,179. In each of these prior art systems the traffic light at each intersection is equipped with a receiving means. For example, the Long patent provides a light beam that is pulsed which is received by the device for controlling the traffic light and the Coll et al patent discloses the system wherein radio signals that are omnidirectional are received by the traffic light controller which radio signals are coded for direction. Systems of this latter type require that the operator know the direction in which he is travelling and can under some circumstances cause confusion and the ability of having the wrong signal transmitted by accident without proper control being initiated at the intersection as desired by the vehicle. The Long patent, on the other hand, utilizes directional control, that is to say four detectors facing in four different directions and the transmitter on the vehicle effectively receives a train of pulses which are then integrated over a finite period of time. It is specifically suggested that ten pulses per second transmitted and that in a two-second period the desired threshhold voltage is reached by the integrating circuit so as to obtain the necessary control. It can be recognized that under some conditions this time span is too long and as a result the circuit can under some circumstances be incapable of acquiring traffic signal control. In addition there is no provision for rejection of false or spurious signals. Further neither of the above mentioned patents provide for the sending of various and different coded words to selectively operate the traffic signals or to provide any other function.

SUMMARY OF THE INVENTION

The present system provides with each traffic signal device at each intersection, a radio receiver working in the microwave range and which is arranged with one or more directional antennas as the particular configuration of the intersection dictates. The receiving and decoding circuitry has an extremely fast response time of less than one-half of a second and permits the vehicle to acquire the signal control in a very short period of time. The transmitter utilizes pulse width modulation in which eight bits will constitute one byte or one word and the decoding circuitry in the receiver will require that eight good words of code be received within the initial period of under a half a second or there will be no response which allows for such problems as noise, momentary interference and so forth, to be minimized. In addition, to prevent false signals from being received, the receiver employs a phase lock loop to synchronize the received signal with that of the transmitter and unless a lock is achieved no signal will go on to control the traffic lights. The transmitter and receiver may employ more than one coded word, each coded word corresponding to a unique instruction to the traffic signal or to a wired or wireless communication link to a central headquarters.

DESCRIPTION OF THE PREFERRED EMBODIMENT

Figure 1:
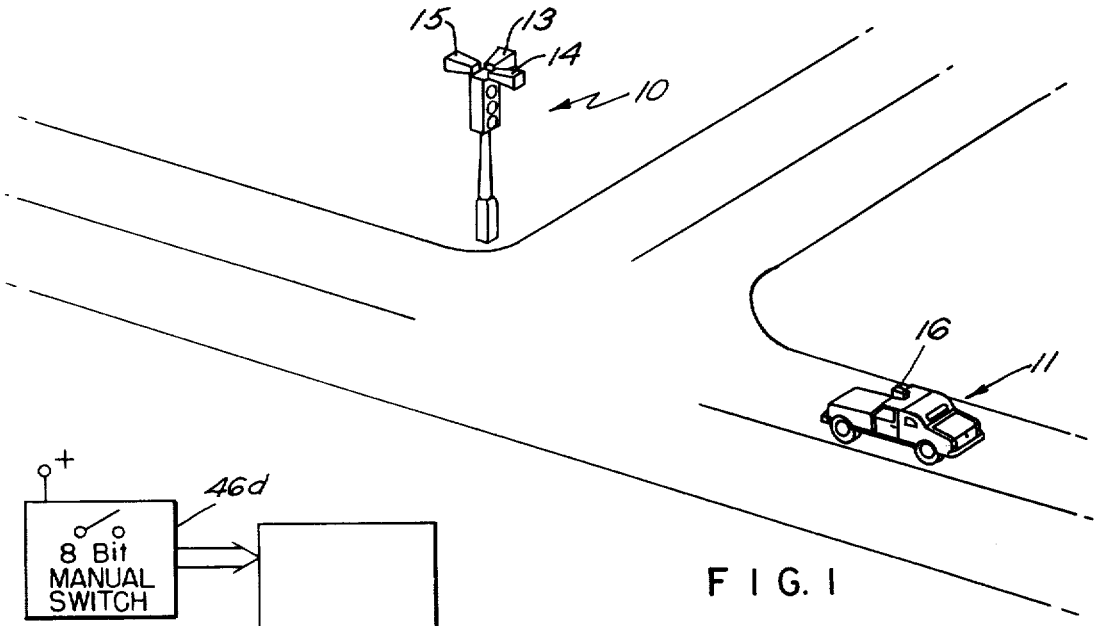
FIG. 1 is a diagrammatic view of a typical intersection illustrating a use of the invention.

Referring to the drawings it can be appreciated that a typical intersection is illustrated with light control in the form of a traffic signal generally indicated 10 with an emergency vehicle 11 approaching the intersection. In general, the traffic signal is provided with directional antennas 13, 14 and 15 and the emergency vehicle 11 is similarly equipped with a transmitting antenna 16.

Figure 2A:
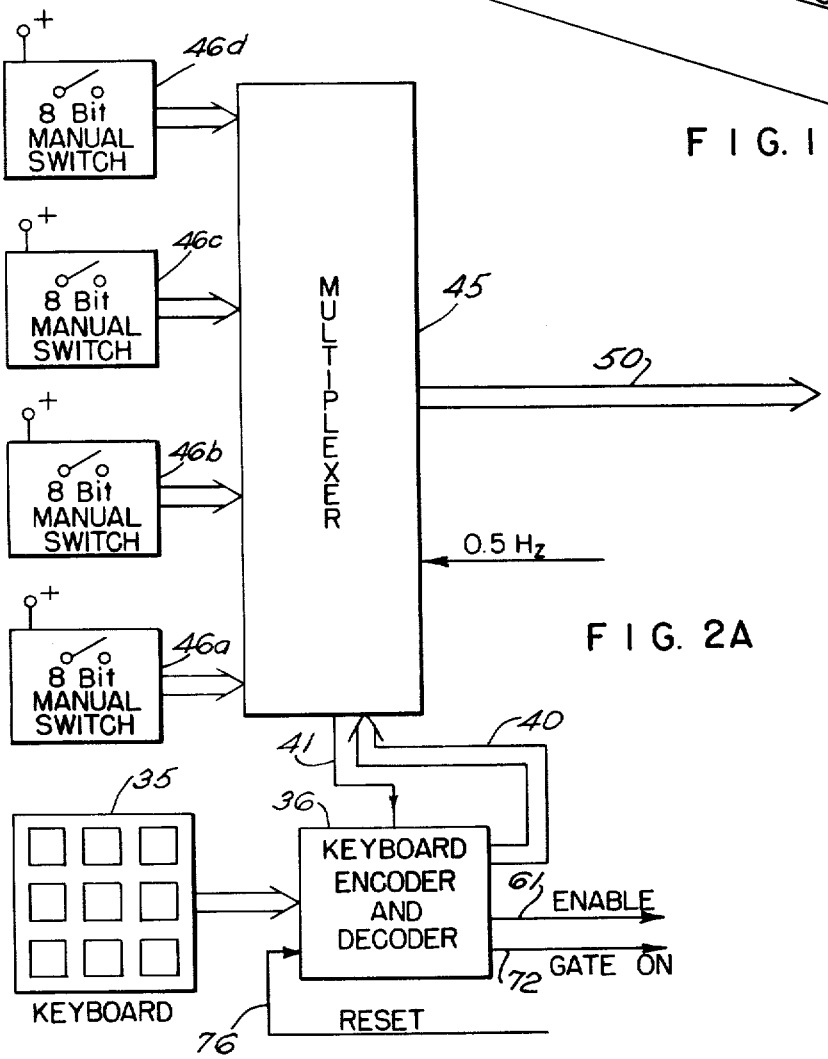
FIG. 2A is a block diagram of a modified control input for FIG. 2.
Figure 2:
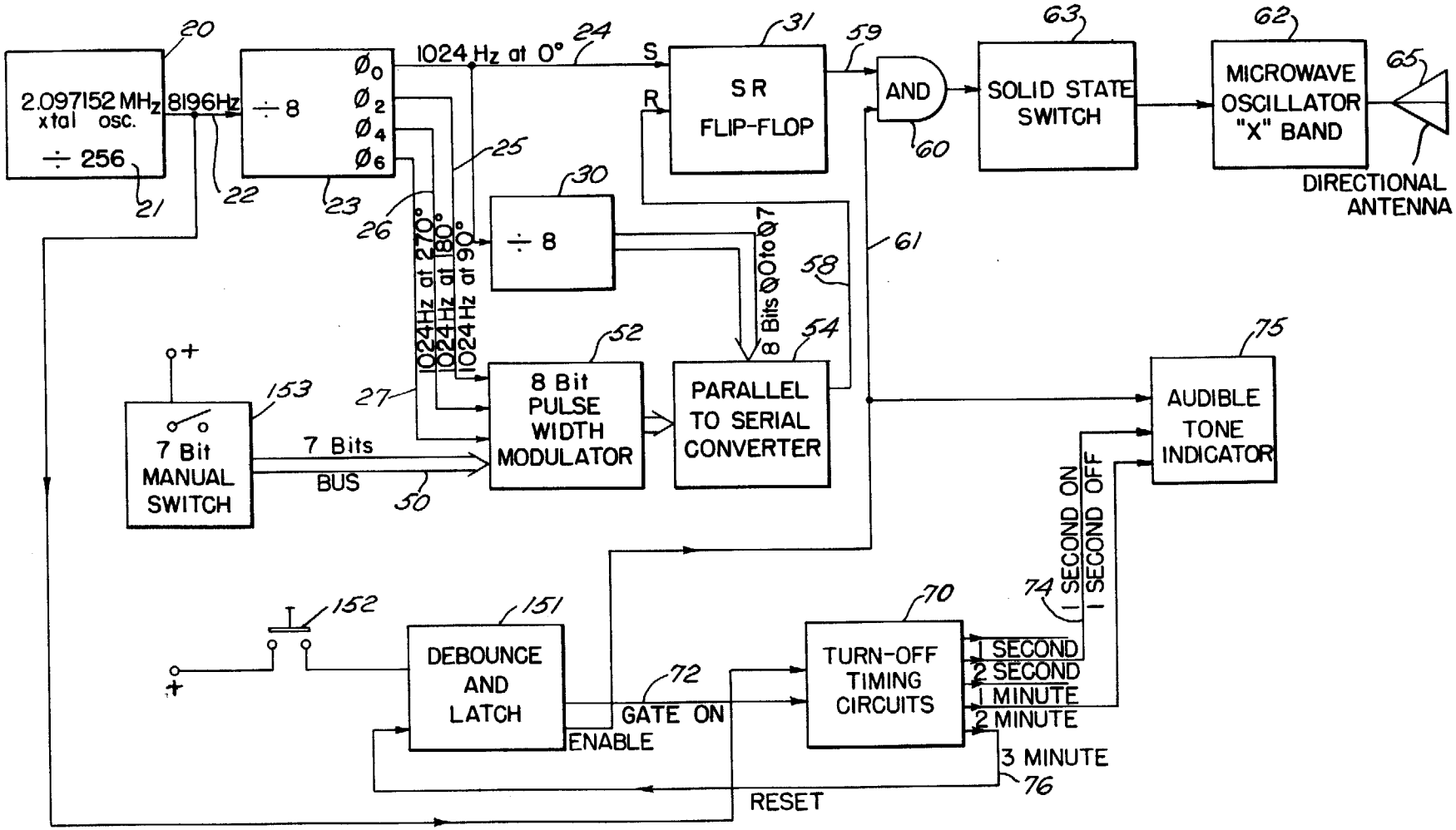
FIG. 2 is a block diagram of a typical transmitter system.

The basic transmitter and receiver units are shown in the drawings and in general by referring to FIG. 2 the transmitter is a pulse width modulated device which turns on and off at a set pulse repetition rate which here has been designed to be 1024 Hz. This is derived from a 2.097152 MHz quartz crystal. To this end, there is shown a crystal oscillator 20 which also includes a divider 21 that divides by $2^8$ or by a factor of 256, the output of which is fed over a bus 22 to a divider 23; the oscillator 20 and divider 21 may be a RCA 4060B; divider 23 may be a RCA 4022B. The output of divider 23 provides a phase output wherein the signal which is now 1024 Hz comes out on bus 24 at 0° phase difference on bus 25 at 90° phase shift, on bus 26 at 180° phase shift and on bus 27 at 270° phase shift. The in-phase signal on bus 24 leads both to a divider 30 which divides by a factor of 8 and to a flip-flop block 31 which sets the flip-flop circuit. In order to initiate transmission, there is provided in the emergency vehicle 11 a push button 152, the output of which feeds debounce and latch circuitry which can be made from Motorola or RCA 4093B and 4013 integrated circuits. The output of the latch enables the turn-off timing circuits 70 over bus 72 and enables AND gate 60 over bus 61.

A coding of the transmitter is provided by 7 bit manual toggle switch 153. The toggle switches effectively set the first seven bits to either 0 or a 1 logic level by appropriately arranging the code to be transmitted.

The output of the seven bit switch is fed over seven bit bus 50 to an eight bit pulse width modulator. Conveniently, the modulator which is designated 52 may be, for example, made up of two Motorola MC14519B Data Selectors in which the control inputs are fed with the 90° and 180° clock outputs on busses 25 and 26, while the seven bit bus 50 feeds the data inputs of the 14519 IC's. The eighth bit is still blank. The seven outputs of the pulse width modulator then feed an 8 bit parallel to serial converter generally designated 54 which consists of a plurality of AND/NOR gates conveniently packaged into a pair of chips, such as RCA 4086B plus an inverter, in which one input of each of seven of the AND gates is fed with an output of the pulse width modulator. One input of the eighth AND gate is fed with the 270° clock output on bus 27. The other input of each of the eight AND gates is fed with one output of the divider 30 which is a Johnson counter with all eight bits brought out. The output of the parallel to serial converter passes over bus 58 to reset flip-flop circuit 31 which may be a Motorola or RCA 4043. The output of the flip-flop on bus 59 then goes to AND gate 60 which can be an RCA 40107B and if this has been enabled over bus 61 from the Debounce and Latch circuits 151, the signal will then be fed out to the oscillator 62 through a solid state switch 63 and thence to a directional horn type antenna 65. To understand how this works, the beginning of each transmitted pulse is achieved by an enable signal over bus 61 from the Debounce-Latch 151 together with a 1024 Hz signal inphase that is at 0° which sets the flip-flop 31. Each of the individual bits which can be transmitted come from the divider 30, there being eight bits and the value of the first seven bits as transmitted is determined by the setting of the seven bit manual switches. Each transmitted pulse is terminated by a reset signal to the flip-flop circuit 31, the pulses being terminated at 90° for a transmitted "0" and 180° or 270° for a transmitted "1". It should also be remembered that the eighth pulse is terminated at 270° and signifies the last bit of an eight bit word.

In order to meet the proper specifications for a transmitting device of this nature timing circuits are provided so that there will be an automatic turnoff within a three minute period. This is achieved by utilizing the clock output from the oscillator 20 which goes to a timing circuit 70 that is turned on by a gate bus 72 from the Debounce-Latch 151. 70 may be 4060B, 14566B and 4022B. Various arrangements of timing circuits can be utilized in the present case there being an output bus 74 which enables an audible indicator 75 to actuate after a two minute interval, the output being a flip-flop type of arrangement with one second on and one second off to tell the driver of the vehicle the transmitter he has one minute to go. After a period of three minutes has elapsed and if the transmitter has not been turned off, the timing circuit over bus 76 will reset the latch 151, turning off the transmitter. The driver must then manually turn on the transmitter again starting a new three minute cycle. The driver may, however, terminate the signal anytime shorter than three minutes.

The receiver employs a directional antenna such as a horn 80 that as noted before is aimed in the proper direction of oncoming vehicle at an intersection. There is then a receiver 81 which effectively has a detector and an amplifier therein so that there is produced on the output a number of serial bits at 1024 Hz. This signal is then applied to a phase lock loop consisting of a phase detector 83 and a voltage controlled oscillator 84 operating at eight times the incoming bit frequency which then has an output that goes to a divide by 8 counter 85. Counter 85 generates phase synchronization at 1024 Hz and generates marking of timing pulses at a zero phase difference on bus 86 at 135° on bus 87 at 225° on bus 88 and 270° on bus 89. The incoming signal is also applied to a transmitter to receiver synchronization circuit designated 90 that resets a divide by 8 counter 91 at the first bit following the stop or last bit. This insures synchronization of the word frequency, that is 1024 divided by 8 which equals 128 Hz and effectively the output of the divider 91 gives us 8 parallel bits and insures that, for example, bit 7 corresponds to bit 7 at the transmitter.

It will also be apparent that the incoming signal is applied over line 82 to an 8 bit serial to parallel converter 93 which includes a latch. The incoming bits are fed over the bus 92 and are questioned for a "0" or "1" at 135° phase difference that is supplied on bus 87 while the last bit is questioned at 225° that is fed to the device on bus 88 and then latched. The output of this converter latch is fed over an eight bit bus 95 to eight bit decoder and lockout device 96 so that the eight bit code word on the latches is compared with the logic levels of the seven bit manual switch as seen schematically at 97 to ascertain if there is any valid code transmitted. Each bit must have logic level correspondence.

If we consider for exemplary purposes that effectively the divider 85 can be a Motorola 4022B and similarly can be the case with the divider 91, 83 and 84 are together an RCA 4046B phase lock loop, the eight bit serial to parallel converter and latch 93 can consist of a plurality of gates such as Motorola 4081B units that feed Motorola 4013B units (or a shift register such as two RCA 4015B with appropriate AND gates) to give us an output of a data bus at 95 with eight bits of information that are compared in decoder-lockout circuit 96, a series of exclusive NOR gates such as Motorola 4077B units and then go to an AND gate 4087B. Alternatively, the exclusive NOR gates may be replaced by two Motorola MC14585 magnitude comparators. If a valid code appears on bus 98, it will be applied to input of divide by 8 counter 99 together with a delay generator 101 set between 0.4 to 0.6 seconds and delay generator No. 2 designated 103 set between 5 and 15 seconds. It eight good words of code are received before the delay 101 times out and resets the divider 99, then the output latch 105 is set activating the emergency traffic signals and also a lockout bus 106 is energized to lock out any other receivers facing other directions. Generators 101 and 103 are RCA 4098B and latch 105 is RCA 4043B. Once the output latch 105 has been set, it will not be reset unless no good code words are received before delay 103 times out. In this fashion the emergency vehicle can temporarily lose microwave contact with a receiver and not lose control of the intersection and also it allows time for the vehicle to clear the intersection.

Figures 3, 3A:
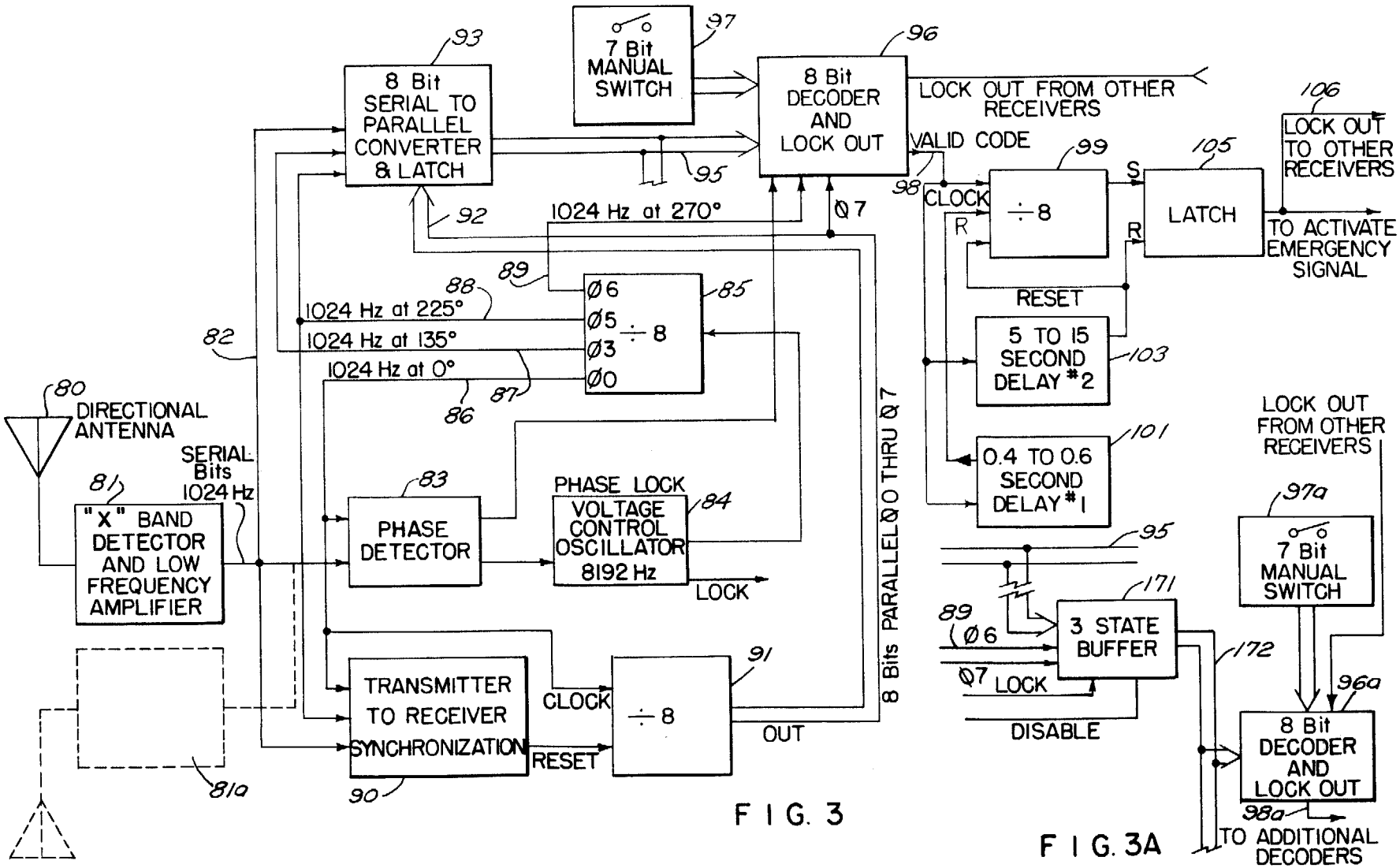
FIG. 3 is a block diagram of a receiver system.
FIG. 3A is a block diagram of a modified addition to the receiver system of FIG. 3.

It will be apparent that once a valid code has gone on through to the latch 105 the decoder circuitry for any other direction and any other receiver circuit is locked out on bus 106. One vehicle only will therefore control the signal at the intersection. There is one Master Decoder card for each major axis and one antenna and receiver 81, 81A for each direction, that is FIG. 3 is repeated for each axis.

We have described above a system wherein a transmitter sends one word of code, such code being determined by the settings on a seven bit switch. When such code is received and matched with an identically set seven bit switch, one command is given to a traffic signal. Obviously, the transmitter may, instead, contain many seven bit switches, each representing a unique code each of which may be separately detected at the receiver. Each code may represent a separate and different command at the receiver. For example, the system described above, which is called a pre-empt function, may be represented by one code. Another code may represent a simple cycling ahead of the phase of the light without any lockout or hold feature. Another code might place the lights in an "all red" condition to facilitate pedestrian crossing. The last two features above would be appropriate to a hand carried (foot patrolman or school crossing guard) transmitter as well as a vehicular mounted transmitter.

A vehicle operator responding to an emergency might wish to set differently the signal at an intersection depending upon which direction he plans to turn. This might require one or more additional code words.

Another code might activate circuitry at the intersection to transmit by wire to a central headquarters the identity of the signalling vehicle and its location. Because of the directional properties of the system, the vehicle will be accurately located and the information cannot be detected by non-police "scanners". This is, in effect, a secure "call box" on the run. This provision will require a unique code for each vehicle while the earlier mentioned codes will be common to a community or group of communities. Other codes might be used to send additional information, such as a call for help, over the call box lines from the vehicle.

The above are given as examples only and are not intended to express any limits to the system. Each of the above codes or functions may be selected by the operator by pressing one or more keys on a keyboard. The system may further be configured to rapidly switch among two or more selected codes by pressing still another key allowing the operator to issue more than one command at the same time.

FIG. 2A shows how such an expanded system may be implemented for four functions. It will be obvious to the practitioner that the idea may be expanded to a greater number of functions. Operation of the transmitter is the same as the transmitter described earlier with the following exceptions:

A keyboard 35 has been provided in place of single push button 152. Debounce-Latch 151 is replaced by keyboard encoder/decoder latch 36. An additional output multi-bit bus 40 from encoder/decoder 36 addresses multiplexer 45. Bus 40 is a binary representation of the particular key of the keyboard that may have been pressed. The address on bus 40 determines which of the several eight bit switches 46*a*, 46*b*, and so forth, is selected and enabled by multiplexer 45 to bus 50 where operation proceeds as earlier described. An eighth bit may be provided on each switch to determine whether that particular code or function will be transmitted continuously or momentarily as may be appropriate to the function. This bit is multiplexed and fed back to 36 over bus 41. Also a 0.5 Hz signal from timing circuits 70 may be gated into multiplexer 45 to rapidly switch among two or more eight bit switches if a fifth key has been depressed. The keyboard encoder/decoder latch 36 may be realized by using a Motorola 14532B priority encoder, 14175B latch, 4013 latch and 4098 monostable multivibrator. The multiplexer may be four Motorola 14539B with appropriate input AND gates type 4011.

The receiver circuitry may be the same as described earlier except that each master decoder card must have additional circuits. Referring to FIG. 3A, existing bus 95 is extended to a three-state buffer 171, the output from which will be bus 172 which will be common to the bus 172 from each and every master decoder card. Buffer 171 is enabled by the "lock" output from Phase Lock 84. Extra bits on bus 172 are synchronizing pulses.

Decoding circuitry must be provided for each function desired. Such circuitry will consist of a seven bit switch 97*a, b, c,* etc.; eight bit decoder and lockout 96*a, b, c,* etc.; bus 98*a, b, c,* etc.; together with a divide by 8 counter 99*a, b, c,* etc.; delays 101*a, b, c,* etc.; 103*a, b, c,* etc. and latch 105*a, b, c,* etc., the latter not being illustrated. The operation of this circuitry is analogous to that described earlier. For those functions where only momentary action is required, delay 103*a* may be omitted and latch 105*a* should be replaced with a pulse generator such as RCA type 4098B. Lockout circuitry in blocks 96 may be omitted for certain low priority functions; that is, they may be locked out themselves but will not lock out another function.

Although the operation of this system has been described using an eight bit word, it would, of course, operate with a longer or shorter word.

The system has been described making use of discrete logic and multi-bit manual switches, it may, of course, be implemented with a micro processor and solid state memory devices.

I claim:

1. An emergency traffic control system having in combination traffic lights including at least a proceed lamp and a stop lamp for directing the flow of vehicle traffic and a control system for said lamps, said control system comprising a first means to directionally receive a directionally transmitted pulse width-modulated signal including word bits transmitted from a vehicle; second means to detect the received signal; third means responsive to the detected signal for reconstructing said signal and including a phase lock loop and a synchronization circuit to synchronize said reconstructed signal with the transmitted signal; fourth means for comparing the reconstructed signal with a preset code of bits and means responsive to the output of said fourth means to generate a control signal to initiate lamp control.

2. An emergency traffic control system as in claim 1 wherein the means responsive to the fourth means is a divide by n counter and a delay generator feeding a latch wherein if n good bits are received before the delay times out the latch is set and initiates lamp control wherein said latch locks out other directional receivers at the same location.

3. Means for remotely controlling a traffic light system comprising:

transmitting means mounted on a vehicle for directionally emitting a signal of serial coded pulse width modulated form containing logic information, means receiving said signal, a synchronizer including means converting the signal into parallel code word form, a phase lock loop containing a voltage controlled oscillator to generate a clock output, said clock output and said signal being applied to said synchronizer whereby each portion of the received signal has the same phase as the transmitted signal, means providing a preset code of bits, means comparing the preset code of bits with the parallel form code word signal and producing an output upon coincidence, the comparator means output initiating control.

4. A device as in claim 3 wherein the output of said synchronizer and the received signal are applied to a latch, each portion of the received signal being questioned for logic level and phase angles and latched for comparison.

5. A device as in claim 3 wherein the output of the comparator means is fed to a latch and a first delay generator including an n-divider wherein if n repetitive words are received before the delay generator times out, the latch is set activating traffic lamp control and wherein a second delay generator operable over a longer period than the first delay generator supplies a reset signal to the latch to restore traffic signal in a preset time after the receiving means fails to receive a proper transmitted signal of serially coded pulses.

* * * * *